US011695229B1

(12) United States Patent
Marshall et al.

(10) Patent No.: US 11,695,229 B1
(45) Date of Patent: Jul. 4, 2023

(54) AUXILIARY POWER CONNECTOR PCB

(71) Applicant: XILINX, INC., San Jose, CA (US)

(72) Inventors: Ieuan James Mackereth Marshall, Baldock (GB); Robert Andrew Daniels, March (GB)

(73) Assignee: XILINX, INC., San Jose, CA (US)

( * ) Notice: Subject to any disclaimer, the term of this patent is extended or adjusted under 35 U.S.C. 154(b) by 151 days.

(21) Appl. No.: 17/179,744

(22) Filed: Feb. 19, 2021

(51) Int. Cl.
*H01R 12/71* (2011.01)
*H01R 12/75* (2011.01)
*H01R 107/00* (2006.01)

(52) U.S. Cl.
CPC ..... *H01R 12/75* (2013.01); *H01R 12/716* (2013.01); *H01R 2107/00* (2013.01); *H01R 2201/06* (2013.01)

(58) Field of Classification Search
CPC .. H01R 12/75; H01R 12/716; H01R 2107/00; H01R 2201/06
See application file for complete search history.

(56) References Cited

U.S. PATENT DOCUMENTS 6,749,439 B1 * 6/2004 Potter ..... H01L 23/467
6,811,427 B2 * 11/2004 Garrett ..... H01R 13/6456 439/378
6,935,868 B1 * 8/2005 Campini ..... G06F 1/186 361/748
7,254,038 B2 * 8/2007 Drako ..... G06F 1/185 361/752
7,359,216 B2 * 4/2008 Hall ..... G06F 1/185 361/752
9,477,630 B2 * 10/2016 Reinke ..... G06F 1/185
10,381,758 B1 * 8/2019 Scanlon ..... H01R 12/716
10,561,036 B1 * 2/2020 Jank ..... H01R 12/716
2002/0072255 A1 * 6/2002 Leman ..... H01R 12/721 439/61
2006/0238991 A1 * 10/2006 Drako ..... G06F 1/185 361/796
2007/0236903 A1 * 10/2007 Hall ..... G06F 1/185 361/796
2009/0111296 A1 * 4/2009 Zhu ..... H01R 12/7005 439/78
2010/0049893 A1 * 2/2010 Drako ..... G06F 13/409 710/301
2010/0254096 A1 * 10/2010 Kim ..... G06F 1/185 361/737
2011/0026217 A1 * 2/2011 Sivertsen ..... G06F 1/18 361/679.41
2013/0021742 A1 * 1/2013 Lee ..... G06F 1/185 361/679.32
2017/0228339 A1 * 8/2017 Shao ..... G06F 13/4282
2017/0371382 A1 * 12/2017 Searby ..... G06F 1/185
2018/0324973 A1 * 11/2018 Hartman ..... G06F 11/3044
(Continued)

*Primary Examiner* — Abdullah A Riyami
*Assistant Examiner* — Nelson R. Burgos-Guntin
(74) *Attorney, Agent, or Firm* — Patterson + Sheridan, LLP

(57) ABSTRACT

Auxiliary power connector PCBs are described. In one example, an auxiliary power connector is described. The auxiliary power connector includes a printed circuit board (PCB) and a PCI express graphics (PEG) connector mounted to the PCB, the PEG connector configured to connect to an auxiliary power source. The auxiliary power connector further includes a set of connectors provided on the PCB, the set of connectors configured to connect the PCB to a main PCB of a device.

20 Claims, 13 Drawing Sheets

(56) References Cited

U.S. PATENT DOCUMENTS

| | | | | |
|---|---|---|---|---|
| 2018/0342826 | A1* | 11/2018 | Leivers | H01R 12/91 |
| 2020/0112114 | A1* | 4/2020 | Chiarelli | H01R 13/631 |
| 2020/0337169 | A1* | 10/2020 | Jank | H05K 7/10 |

* cited by examiner

AUXILIARY POWER CONNECTOR PCB

TECHNICAL FIELD

Embodiments of the present invention generally relate to power circuits, and in particular to a printed circuit board ("PCB") used to connect to an auxiliary power connector to a motherboard of a device.

BACKGROUND

On standard Peripheral Connect Interface Express (PCI-e) cards, such as for example, graphics cards, a standard auxiliary power PCI express graphics (PEG) connector is connected to a main PCB by soldering lead wires from the PEG connector to the PCB. Such PEG connectors allow the PCI-e card to draw power from, for example, a standard PCI-e x16 connector as well as the auxiliary power source. In some examples a PCI-e slot provides a maximum of 75 watts of power, and the PEG connector can supply the graphics card with an additional 75 watts. However, connecting the PEG connector to the main PCB requires an extra process step. This is because the lead wires must be hand soldered onto the main PCB assembly. The extra step slows down production, and also adds human error to the manufacturing process.

It is noted that large electrical currents are passed through the PEG connector. Thus, the lead wires are thick, due to the large currents they must support. To solder them by hand to the PCI-e card requires use of a high heat soldering element, which must be brought into close proximity to the main PCB. This increases the incidence of damage to the main PCB board and its components.

What is needed is a PEG connector design that overcomes the aforementioned problems of the prior art.

SUMMARY

Auxiliary power connector PCBs are described. In one example, an auxiliary power connector includes a printed circuit board (PCB) and a PEG connector mounted to the PCB, the PEG connector configured to connect to an auxiliary power source. The auxiliary power connector further includes a set of connectors provided on the PCB, the set of connectors configured to connect the PCB to a main PCB of a device.

In another example, a method of providing an auxiliary power connector is described. The method includes providing a PCB, and mounting a PEG connector to the PCB, the PEG connector configured to connect to an auxiliary power source. The method further including providing the PCB with a set of connectors, the set of connectors configured to connect the PCB to a main PCB of a device.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements of one embodiment may be beneficially incorporated in other embodiments.

DETAILED DESCRIPTION

In one or more examples, a PCB may be configured to improve manufacturability and to save space by replacing cables for auxiliary power delivery in a PCI-e card using a PEG power connector.

As noted above, on standard PCI-e cards a standard PEG connector is connected to the PCB using soldered wires. High electrical currents are passed through the auxiliary power connector. Conventional production methods thus require an extra process step because the wires must be soldered into the main PCB assembly. In one or more examples, a standard PCI-e card may be modified such the lead wires may be removed, and space taken by the auxiliary power connection minimized within externally defined constraints of the PCI-e form factor. In other examples, the same principles are also applicable to other, non PCI-e form factors to achieve similar efficiencies. In one or more examples, power from the PEG connector to the main PCB may be transferred without soldering wires. This removes wire soldering operations from the production process, reduces the cost of manufacture and improves reliability. Furthermore, the profile of the PCB solution as orientated vertically is narrower than the equivalent wired solution, so saving space throughout the system to allow for other uses of the limited volume available.

Figure 1A:
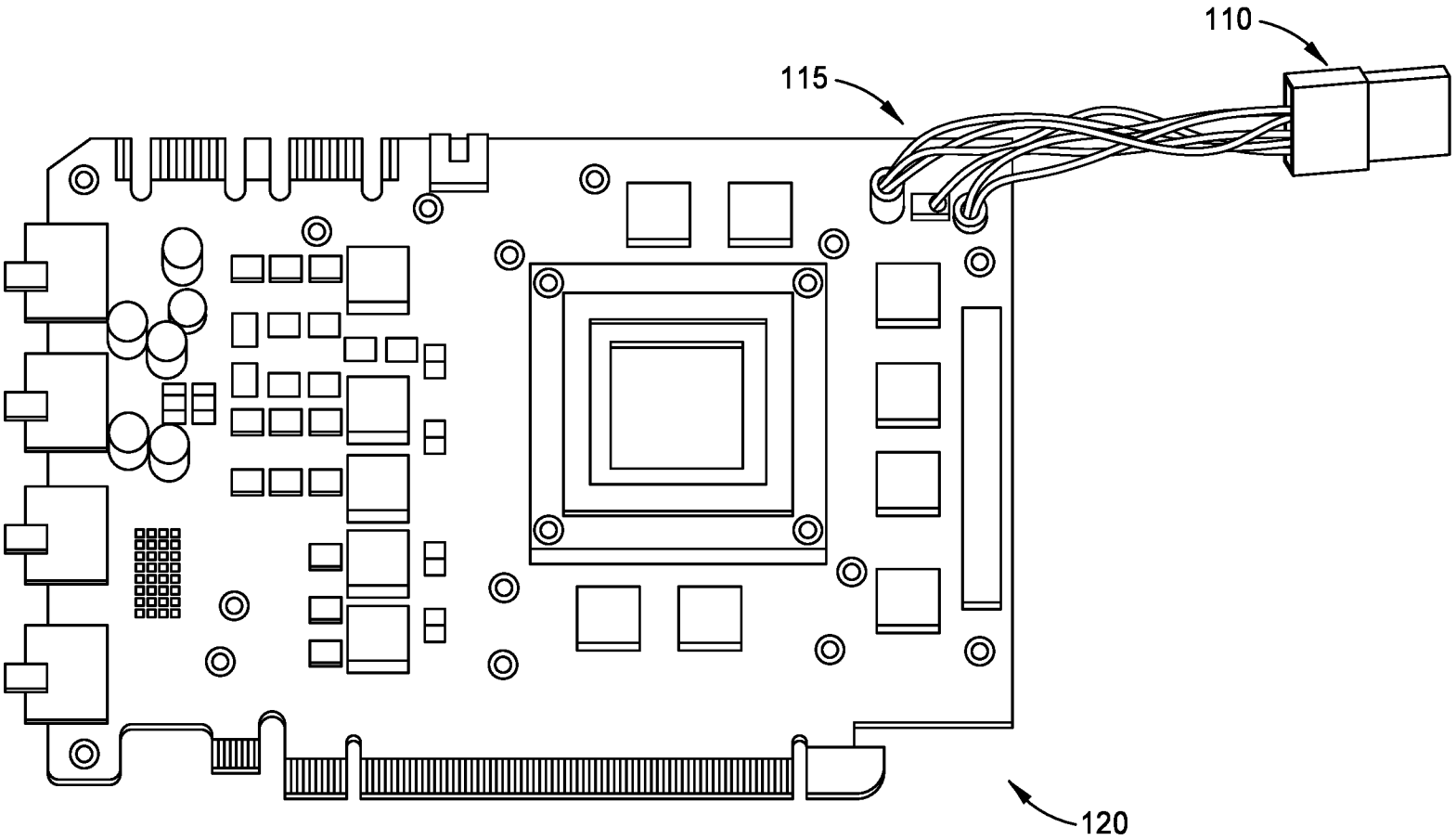
FIG. 1A (PRIOR ART)
FIG. 1A illustrates an example conventional graphics card with a 6-pin PEG connector soldered to it.

FIG. 1A illustrates an example conventional graphics card with a 6-pin PEG connector soldered to it. With reference to FIG. 1A, PEG connector 110 is shown at the top right of the figure. As also shown in FIG. 1A, the six lead wires coming from the PEG connector 110, three of them red, the other three black, are soldered to the upper right corner of the circuit board 120 of the graphics card.

Figure 1B:
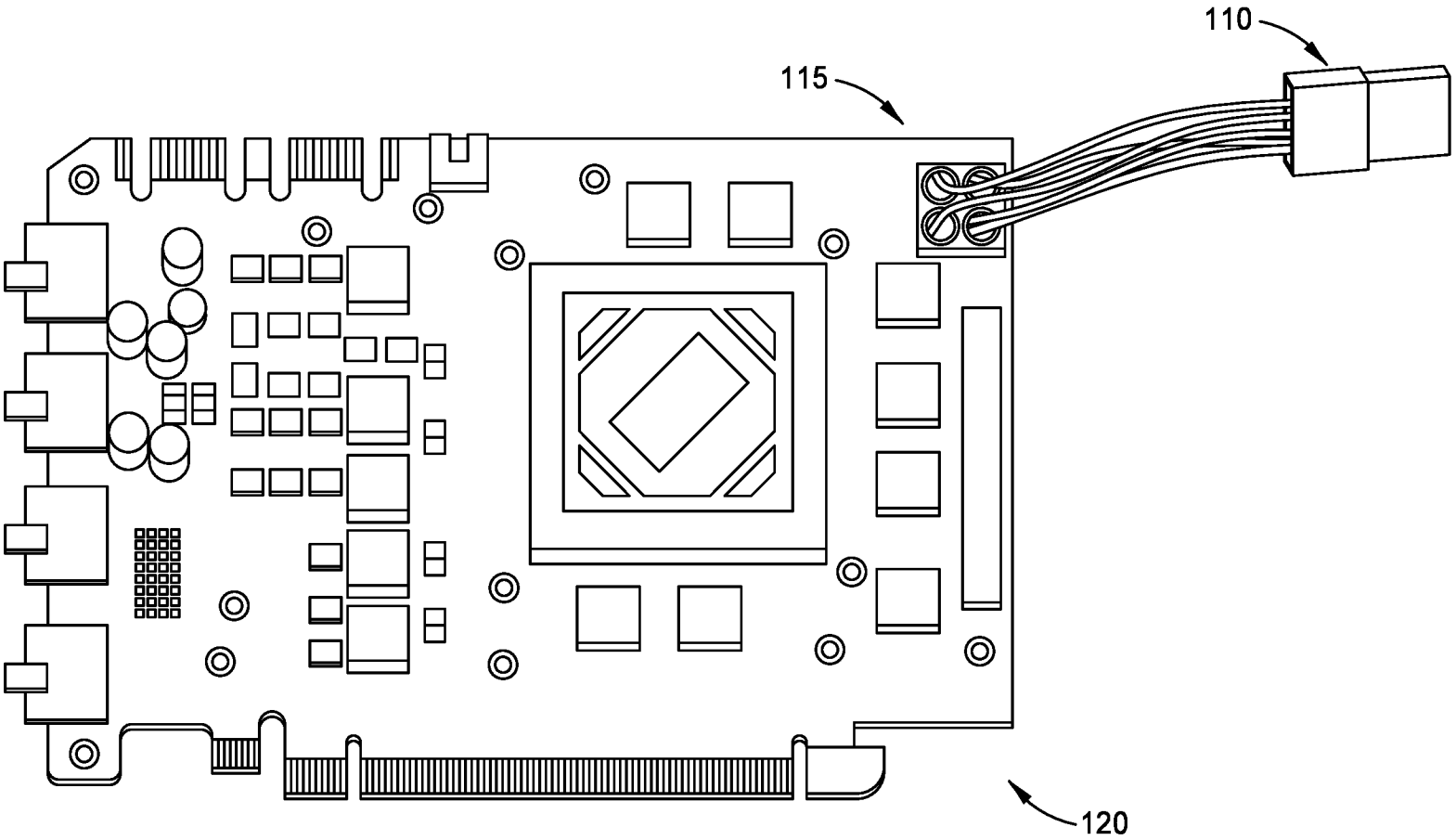
FIG. 1B (PRIOR ART)
FIG. 1B illustrates another example of a conventional graphics card with a 6-pin PEG connector soldered to it.

FIG. 1B illustrates another example of a conventional graphics card with a 6-pin PEG connector soldered to it. As shown, there is a PEG connector 110, at the top right of the figure. The yellow and black lead wires coming from the PEG connector 110, are soldered to the upper right corner of a circuit board 120 of the graphics card.

Figure 1C:
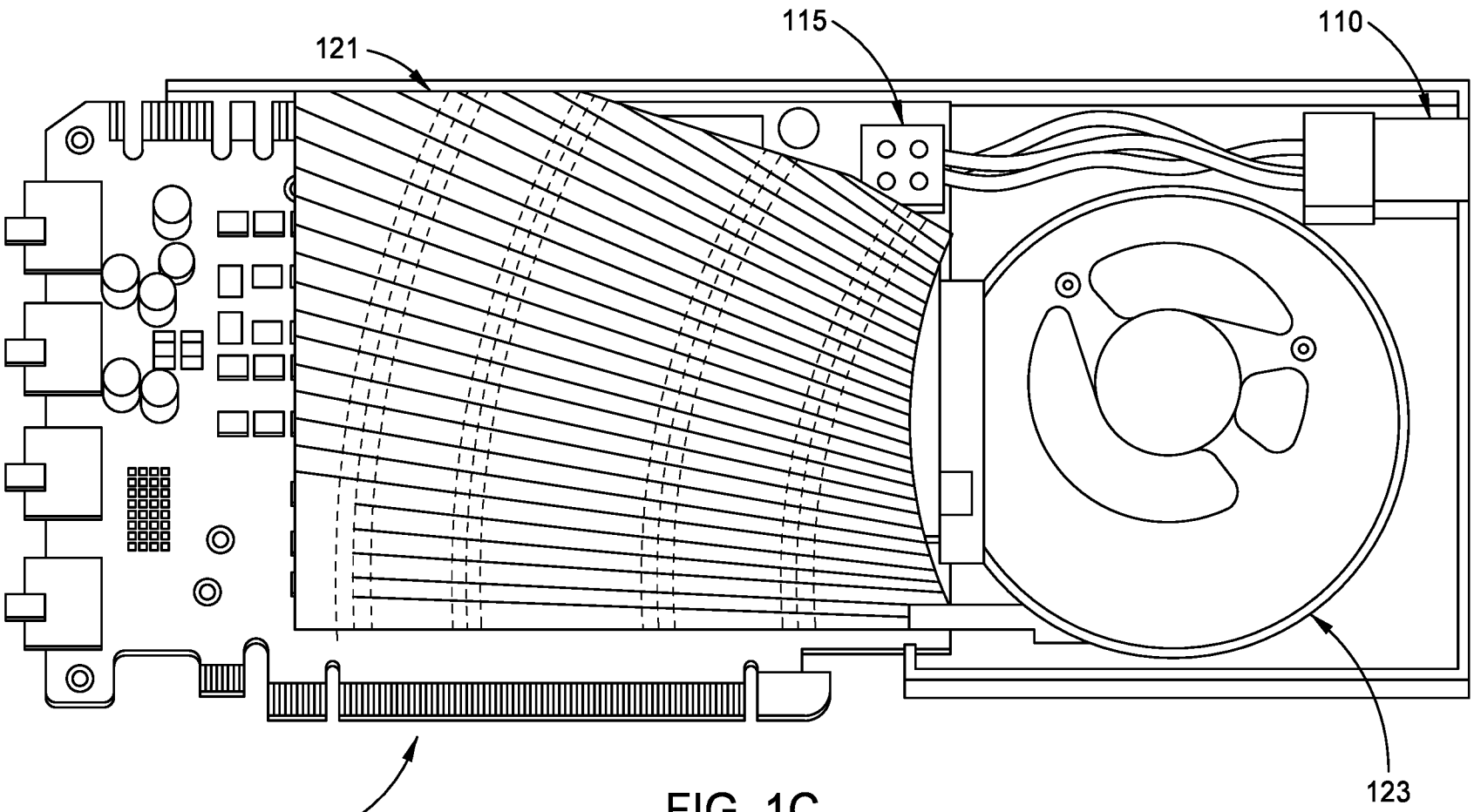
FIG. 1C (PRIOR ART)
FIG. 1C illustrates the example conventional graphics card of FIG. 1B provided in a frame with a heat sink and fan blower.
Figure 2A:
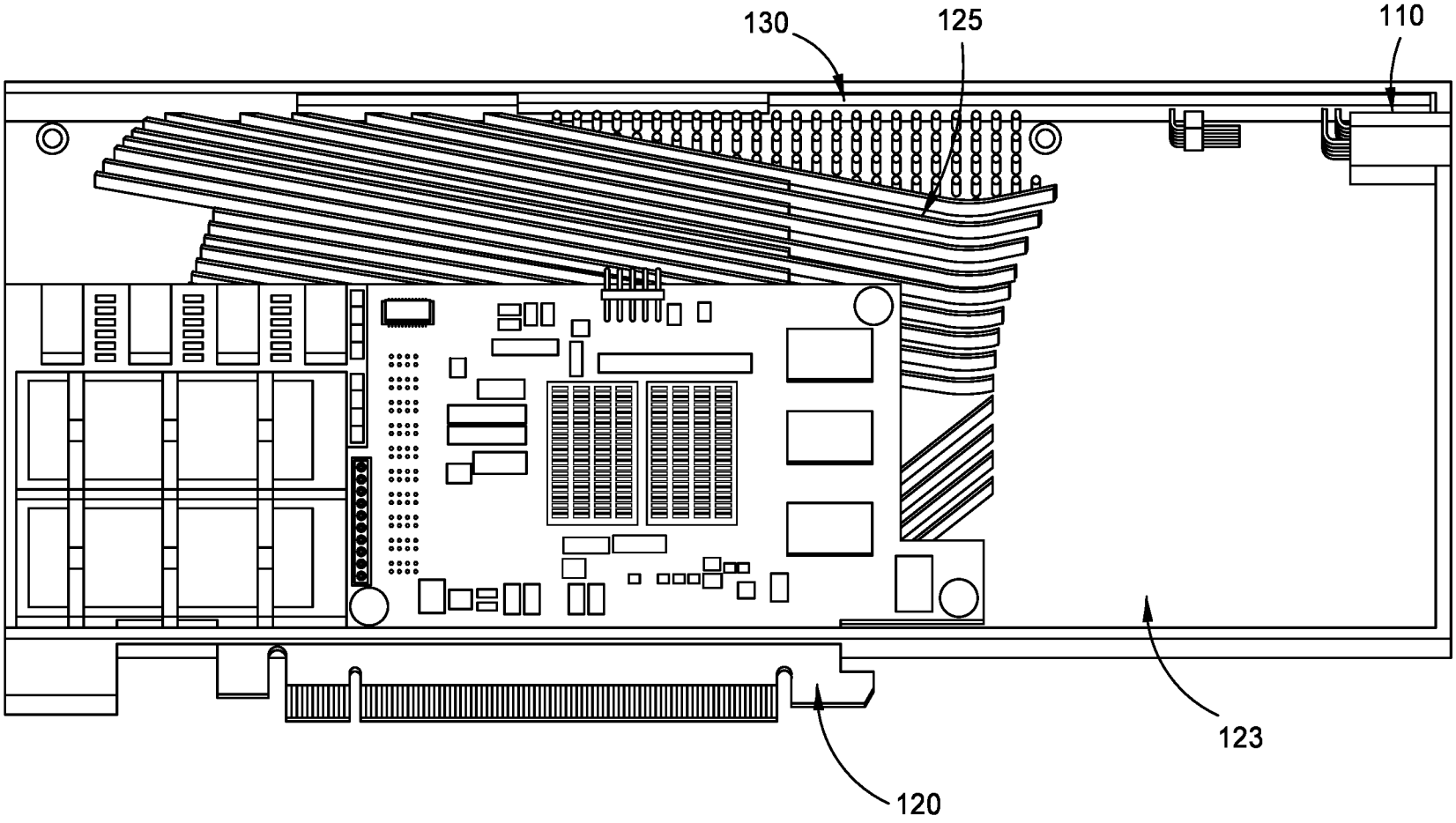
FIG. 2A illustrates an example PEG connector PCB provided in a frame, according to an example.
Figure 2B:
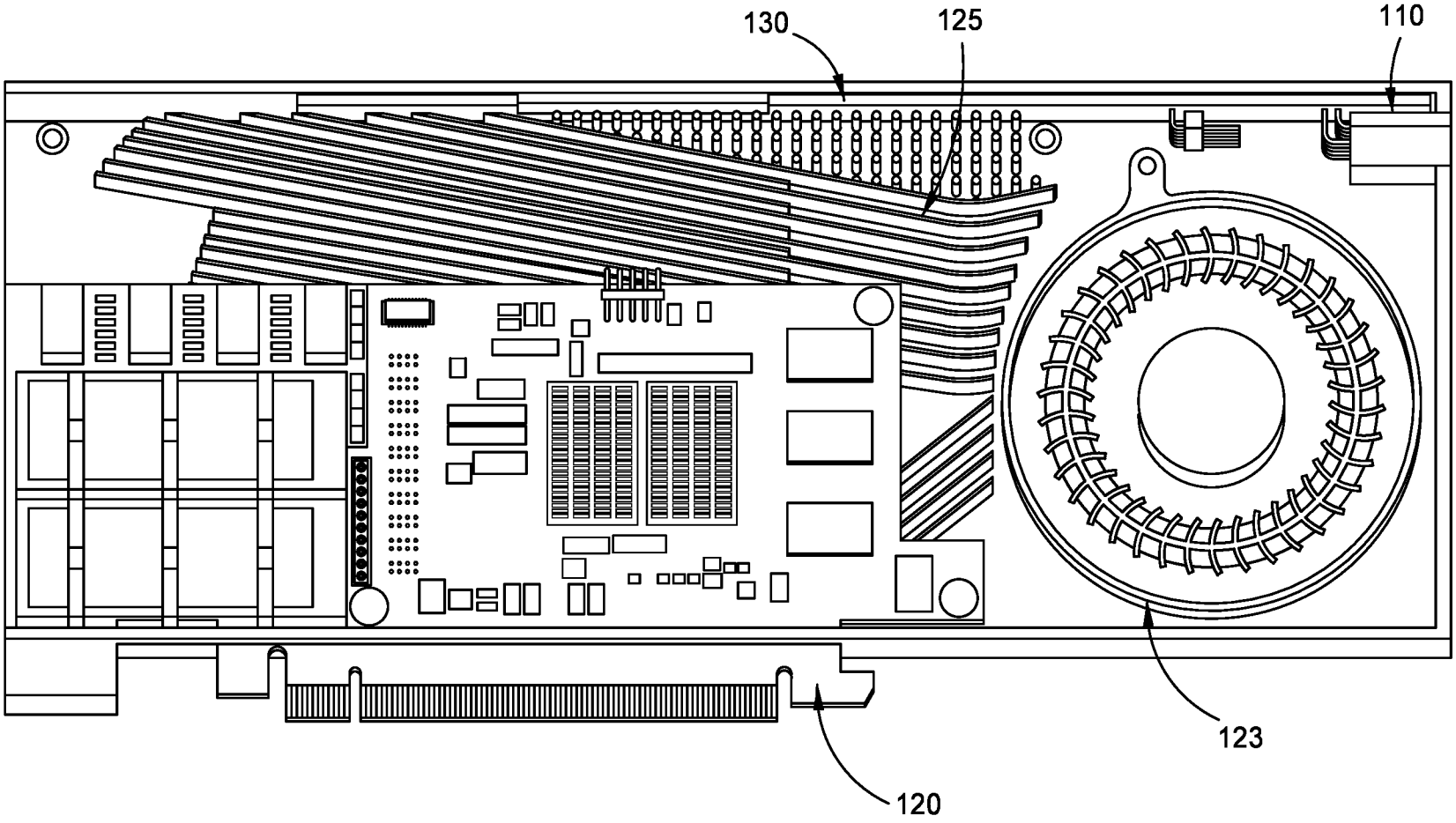
FIG. 2B illustrates the example of FIG. 2A, with added fan blower.

FIG. 1C illustrates the example conventional graphics card of FIG. 1B as provided in a frame with a heat sink 121 and an area 122 for a fan blower (the fan blower itself is not shown, but one is shown, for example, in FIG. 2B). As shown, lead wires 116 occupy significant space, running from the PEG connector 110 at the top right of FIG. 1C to the soldered connection 115. It is noted that in both of the conventional examples of FIGS. 1A and 1B, the PEG connector wiring occupies space that, if freed up, might allow for other uses, such as, for example, a larger heatsink or blower. Moreover, the wiring occupies significant PCB real estate on the motherboard.

FIG. 2A illustrates an example PEG connector PCB provided in a frame with a circuit board 120 of a device, according to an example. In one or more examples, the device may be a graphics card, or, for example, a hardware accelerator. In this example, circuit board 120 is an auxiliary circuit board, not the actual main circuit board of the device. With reference to FIG. 2A, the PEG connector PCB 130 is shown at the top of the figure. It is oriented to be perpendicular to the circuit board 120, so that it is flush to the vertical wall of frame 135. At the right end of PEG connector PCB 130 is the PEG connector 110, which is attached to the PEG connector PCB 130, and connected by two rows of "L" shaped leads 117. The L-shaped leads are part of the component when the PEG connector is supplied in the illustrated form—as a right-angle through-hole component. In this example the PEG connector 110 is a 6-prong PEG connector. However, in other examples it may be a 8-prong PEG connector, which can deliver more power to the device, if needed. Thus, in such examples, the PCIe card may be higher than the depicted one-slot example shown in FIG. 2A, and may be, for example, a 2-slot or 3-slot high card so as to accommodate more/larger connectors. In such alternate examples, the connector at the other end of the PEG connector PCB may be optimized for the maximum expected current. For a given connector style that would mean more pins.

Continuing with reference to FIG. 2A, there is also shown heat sink 125, as well as a space 122 for a fan blower (shown in FIG. 2B). In one or more examples, to further save area on a main circuit board of the device (shown in FIGS. 3A and 3B) , a fan controller, e.g., fan control circuitry, may also be provided on PEG connector PCB 130. This is described in greater detail below with reference to FIGS. 3C, 3D and 4A. In some examples, other components of the device that would otherwise need to be provided on the main circuit board of a device may also be provided on PEG connector PCB 130 These may include, for example, an auxiliary power inlet fuse, a power convertor or regulator, a temperature sensor, an LED indicator, or LED lighting. Thus, in one or more examples, the use of the separate PEG connector PCB 130 allows various components of the device to be moved to the PEG connector PCB 130, as needed, to increase useable area of a main PCB of the device.

Additionally, because PEG connector PCB 130 is mounted substantially perpendicularly to PCB 120 (and thus also substantially perpendicular to a main circuit board of the device, which is mounted underneath and substantially parallel to PCB 120), the width of the PEG connector PCB 130 is along a vertical axis of the frame, and thus creates more room in the horizontal dimensions of the frame, where the main PCB is provided. This also allows for larger accessories, such as heat sink 125 and fan blower 123. It is noted that the term "substantially" as used herein refers to a value or measurement within +/−10%, or to within standard manufacturing tolerances, whichever is greater. Thus, two planes that are substantially perpendicular to each other may subtend an angle between them of anywhere from 81 degrees to 99 degrees, and that this angle may vary along the surfaces, as the planes themselves may be only substantially planar.

FIG. 2B illustrates the example of FIG. 2A, with added fan blower 123. As noted by comparing the layout of FIG. 2B with that of the device of FIG. 1C, it is easily seen how the lead wires 116 of the conventional device of FIG. 1C have to fit in an area above the fan blower 123, and thus take up much more space than do the leads 117 of FIG. 2B, which are much shorter, and connect to PEG connector PCB 130 adjacent to the PEG connector 110.

Figure 3A:
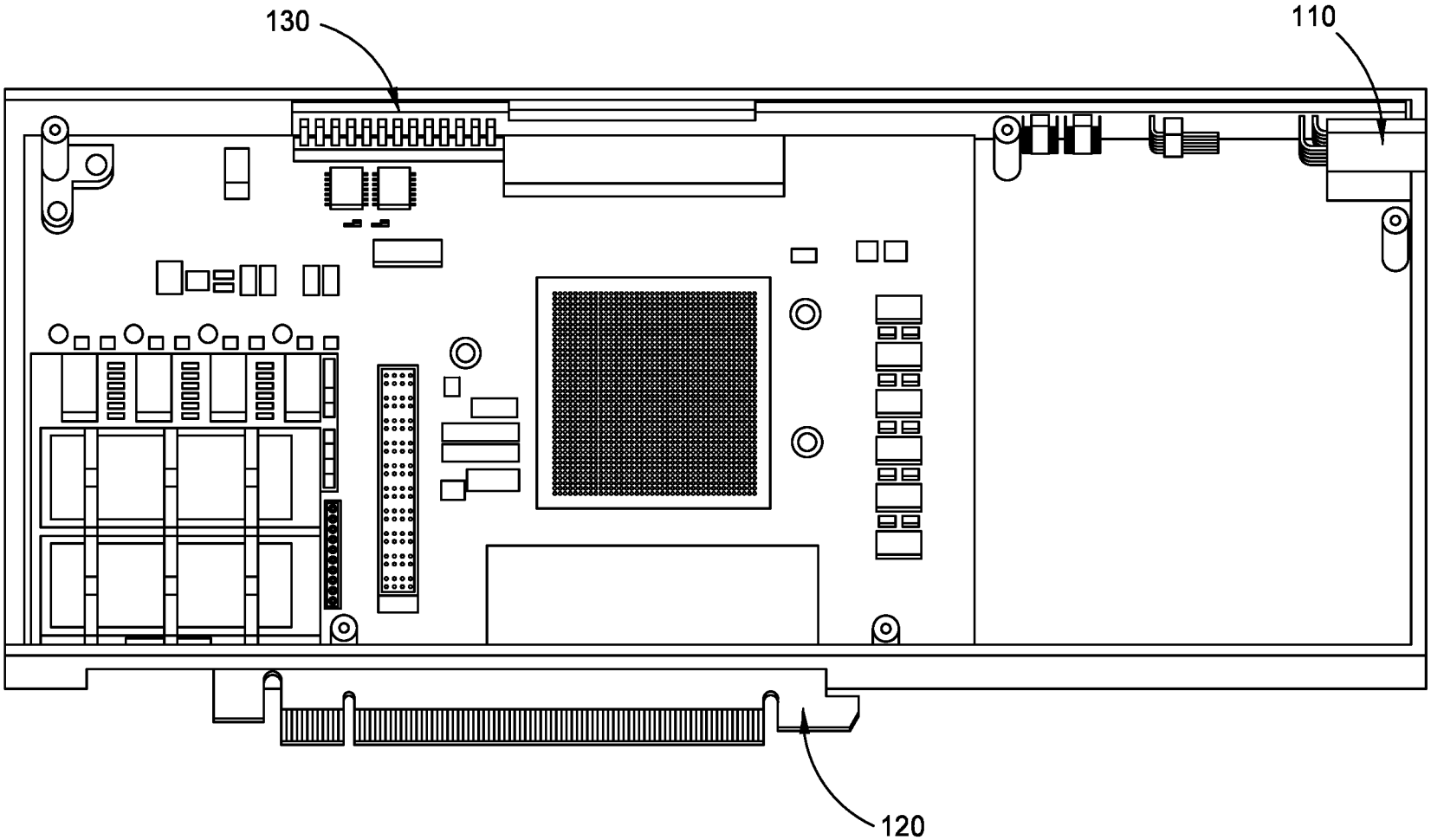
FIG. 3A illustrates an example PEG connector PCB provided in an example accelerator card frame, according to an example.

FIG. 3A illustrates an example PEG connector PCB 130 provided in an example accelerator card device, according to an example. The accelerator card device may be, for example, an Xilinx DCG Alveo™ type accelerator card, provided by Xilinx, Inc., of San Jose, Calif. The accelerator card includes a frame 135, which has a large bottom area and a short vertical wall around its periphery. As shown, PEG connector PCB 130 is attached to the interior of the rear wall of frame 135. Because the thickest portion of the PEG connector PCB 130 is the height (protrusion) of the actual PEG connector 110, and the PEG connector is provided to the right of the actual main circuitry of the device, the PEG connector PCB 130 does not limit the area of the main PCB 124.

Figure 3B:
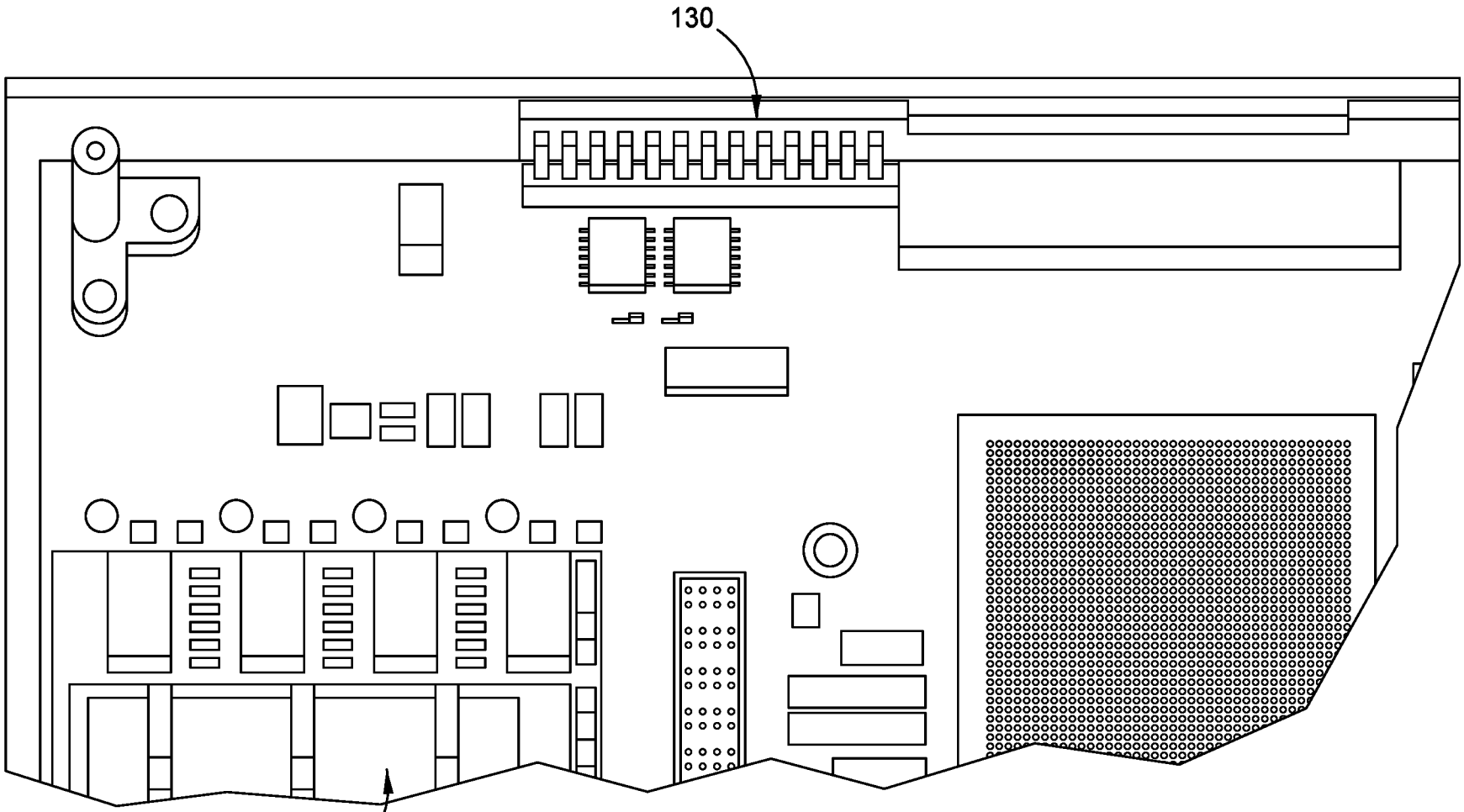
FIG. 3B is a magnified view of a portion of the PEG connector PCB of FIG. 3A that connects to a main PCB.
Figure 3C:
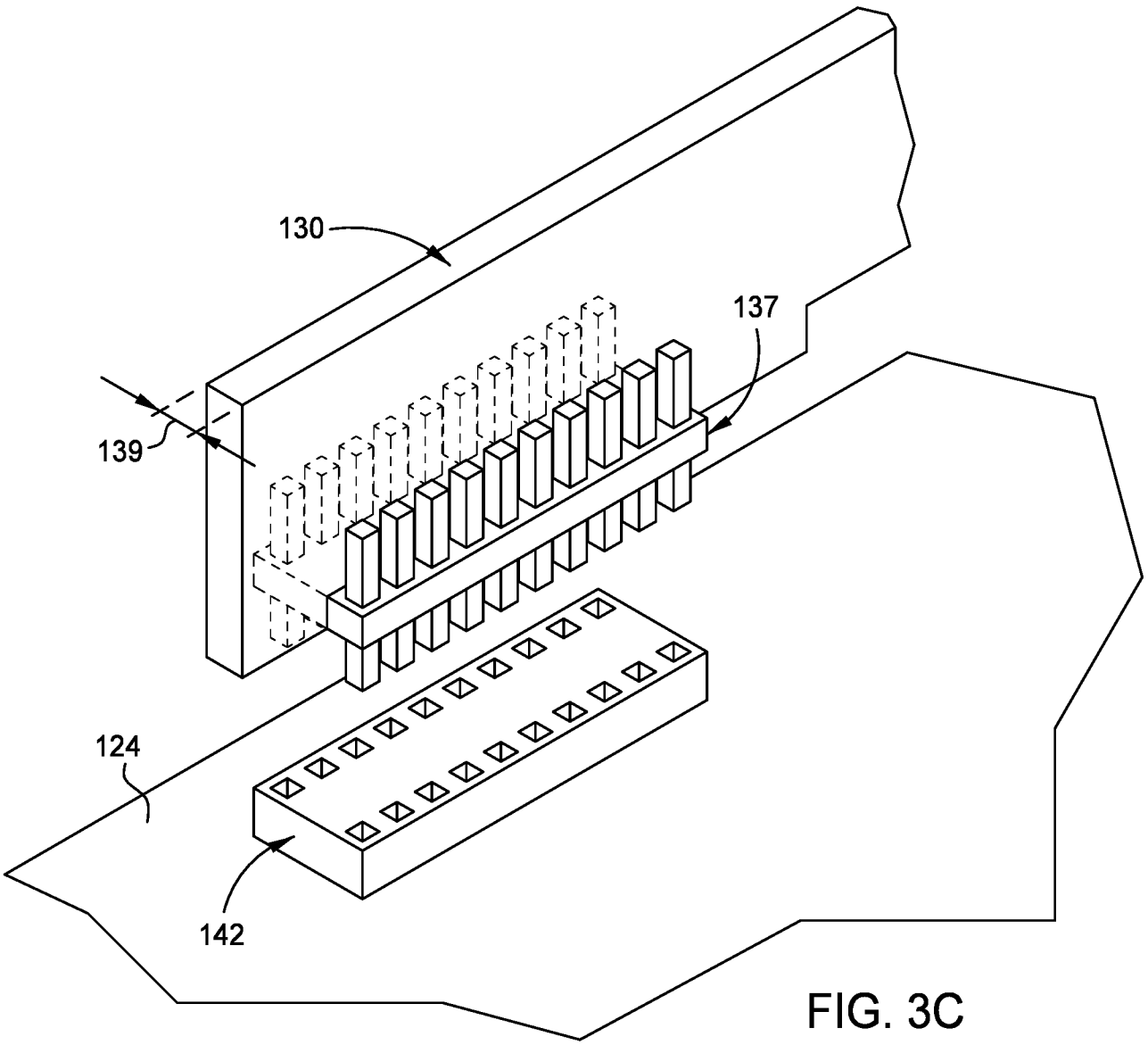
FIG. 3C illustrates an example set of connectors of a PEG connector PCB, according to an example.

FIG. 3B is a magnified view of a portion of the PEG connector PCB 130 of FIG. 3A that connects to a main PCB 124. In one or more examples, the PEG connector PCB 130 may be provided with a set of connectors 137 at its left end by means of which it connects to main circuit board 124. In one or more examples, the set of connectors 137 may be standard push header connections. These headers are components with one or more rows of metal pins passing through and held in place by a plastic bar. In a typical implementation, the part of the pins protruding from one side of the plastic bar would be soldered into holes in a PCB in order to provide a row of metal pin connections on the other side of the plastic bar, perpendicular to that PCB, for connection to some other mating socket. However as another space-saving measure, in one or more examples, the connector is not soldered into holes in the PEG connector PCB 130. Rather, as shown in FIG. 3C, it is soldered directly onto both outer surfaces of the PCB. In one or more examples, the thickness D 139 of PEG connector PCB 130 is specified so as to allow it to slot exactly into the gap between the header pins of the set of connectors 137. This presents pins co-planar with the PEG connector PCB 130 for connection into a complementary socket component 142 on the main PCB 124. Additionally, if, based on the size, or number, of PEG connectors used, if it is calculated that more pins are required to carry the extra current, the number of holes in the complementary socket 142 on the motherboard may be increased to match the number of pins presented by the PEG connector PCB, which may also entail a change to the motherboard.

Figure 3D:
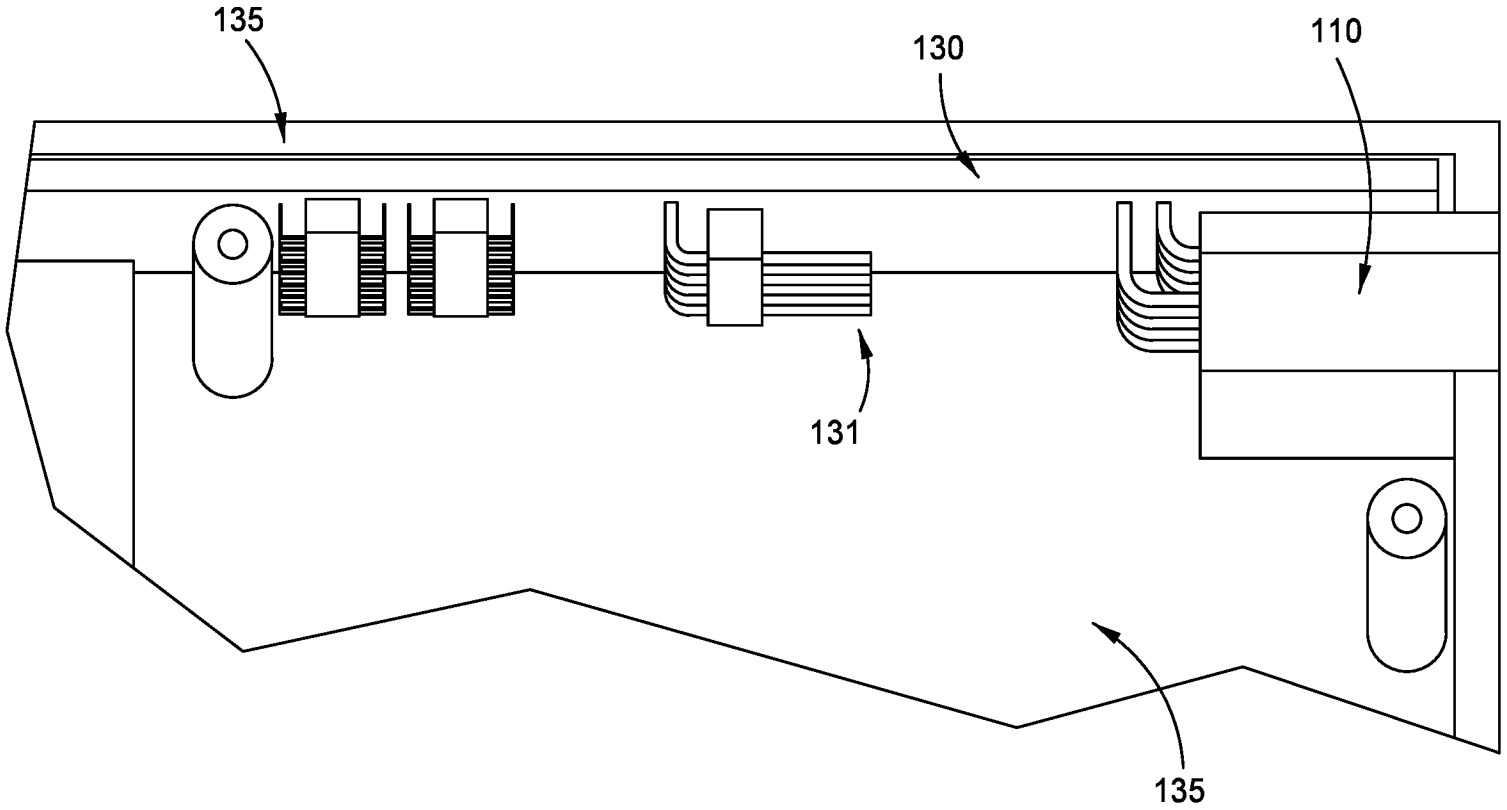
FIG. 3D is a magnified view of a portion of the PEG connector PCB of FIG. 3A illustrating fan blower control prongs and the PEG connector.
Figure 3E:
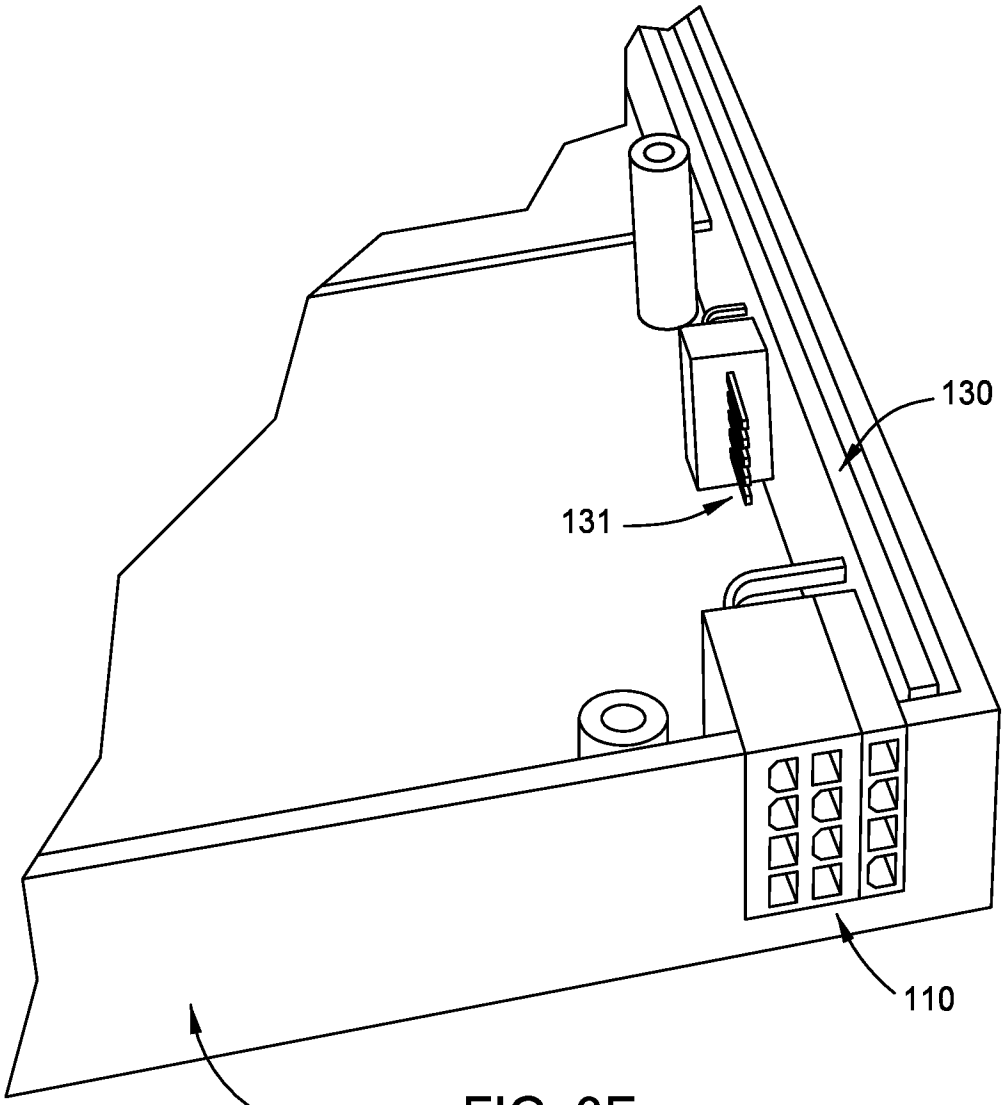
FIG. 3E is an alternate view of the example PEG connector board of FIG. 3A.

FIG. 3D is a magnified view of a portion of the PEG connector PCB 130 of FIG. 3A illustrating fan blower control prongs and the PEG connector. The fan itself is not installed in this example. With reference thereto, there is shown PEG connector 110, the bottom surface of frame 135, and, on the PEG connector PCB 130, fan blower control prongs 131, which are configured to be inserted into a corresponding connection on the fan. To the left of the fan blower control prongs 131 there is a fan controller 132, flush with the surface of PEG connector PCB 130. FIG. 3E is an alternate view of the example PEG connector board of FIG. 3A, from a point of view outside of the frame 135 and looking in to the outer surface of the PEG connector 110.

Figure 4A:
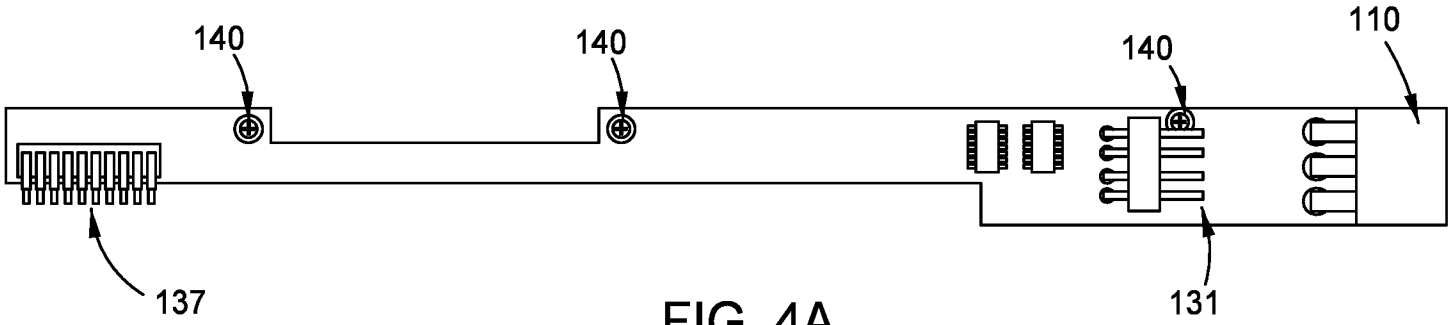
FIG. 4A depicts a front view of an example PEG connector PCB, according to an example.
Figure 4B:
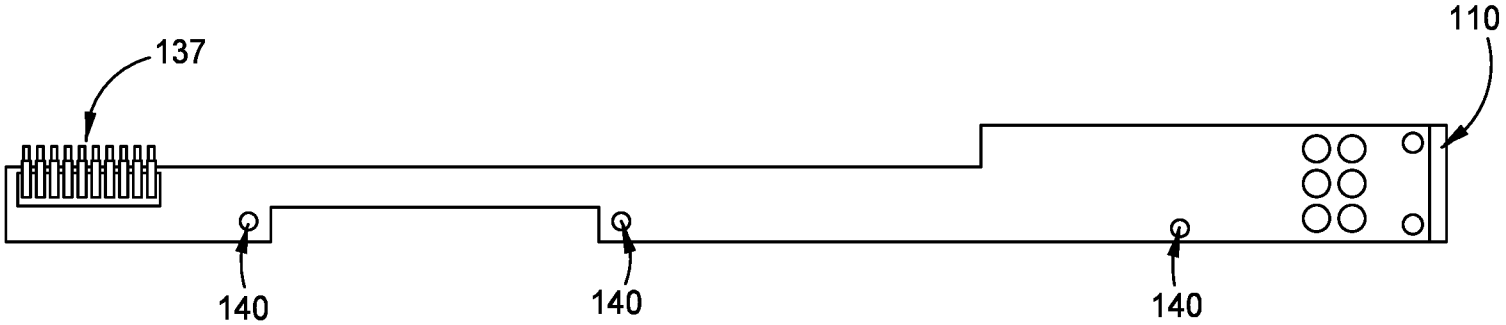
FIG. 4B depicts a rear view of the example PEG connector PCB shown in FIG. 4A.

FIG. 4A depicts a front view of an example PEG connector PCB 130, according to an example. Shown at the left side of the PEG connector PCB 130 are connectors to motherboard 137, which, as noted above, may be standard push header connections. There are also shown a set of screw holes 140, through which the PEG connector PCB 130 may be attached to a frame of an example device. At the right side of the PEG connector PCB 130 is shown the fan blower control prongs 131, and, as noted above, to their left, is a fan controller 132. Finally, at the far right of the figure is the PEG connector 110. Similarly, FIG. 4B depicts a rear view of the example PEG connector PCB shown in FIG. 4A, with some of the elements shown in FIG. 4A also visible from the rear. In particular, PEG connector connections 111 to the PEG connector PCB 130. As shown, as opposed to the conventional soldering to the top of a main PCB, the six lead wires are attached using a solder re-flow process, not requiring any human hand soldering.

Figure 5:
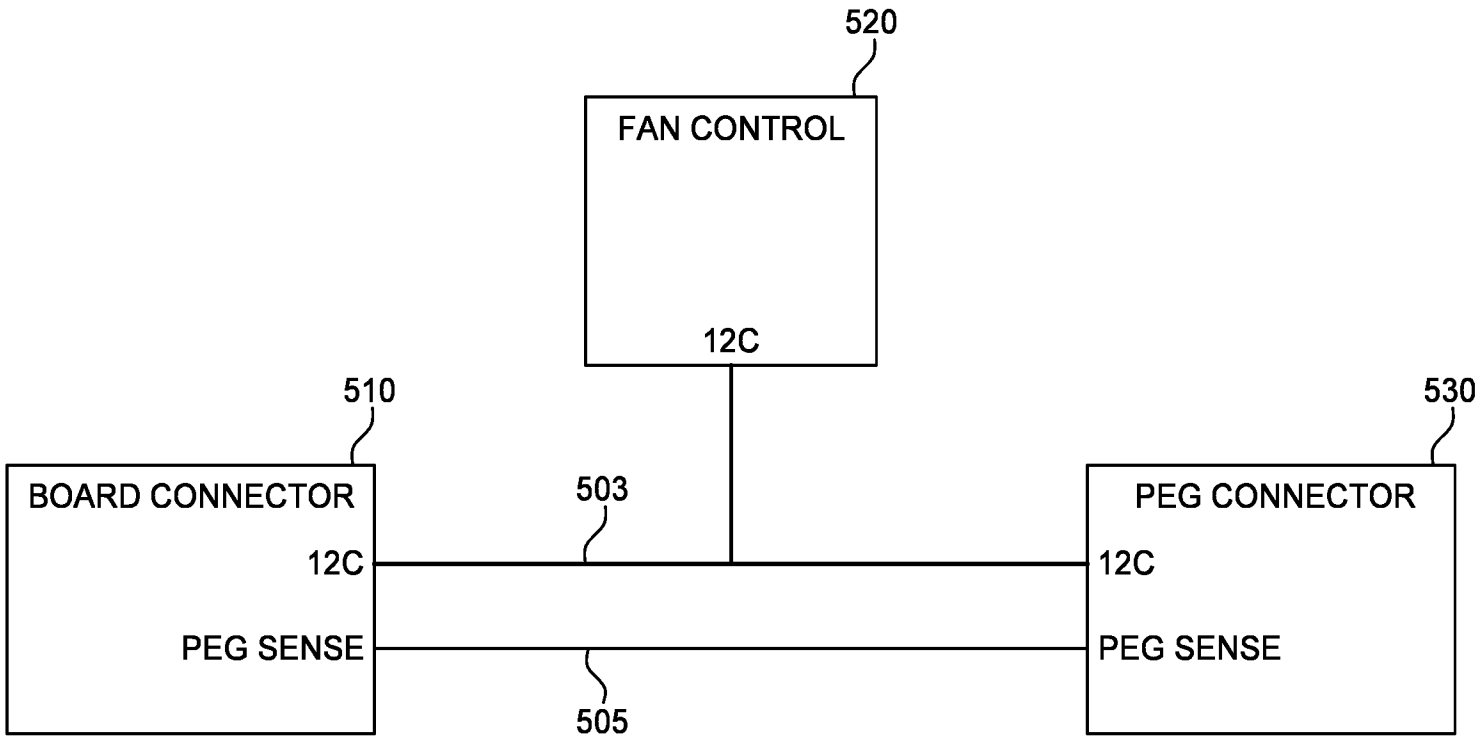
FIG. 5 is a schematic drawing of connections between elements of an example PEG connector PCB, according to an example.

FIG. 5 is a schematic drawing of connections between three basic elements of an example PEG connector PCB, as shown in FIGS. 4A and 4B, according to an example. With reference to FIG. 5, the PEG connector 530 is connected to the board connector 510 via PEG_SENSE line 516. The function of the PEG_SENSE signal is defined by the PCIe Electromechanical Specification and allows a PCIe card to detect whether an auxiliary power cable from the power supply has been physically connected into the PEG connector. It does not detect if power is actually being provided per se. It is connected to ground (GND) by an auxiliary power cable when it is inserted, but otherwise it is not connected to GND, and the difference can be detected by a PCIe card. Board connector 510 is also connected via I2C connection 515 to the fan controller. This allows communication between a microprocessor on the motherboard and the fan controller, for example, to request or detect changes in the fan speed, fan faults, etc.

Figure 6:
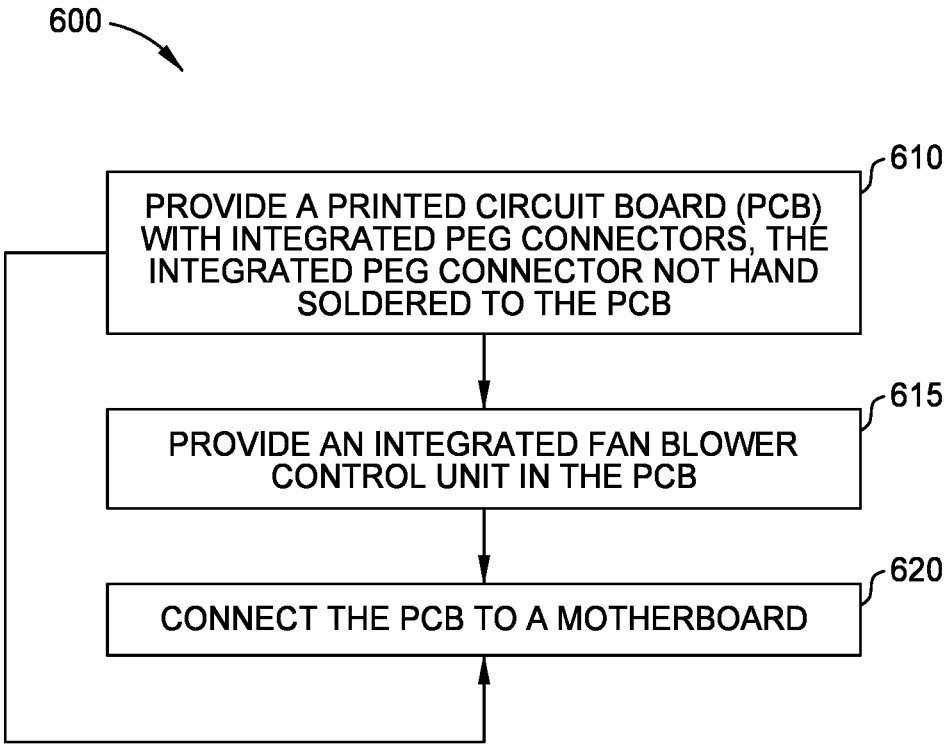
FIG. 6 is a flow diagram of a method for providing a PEG connector PCB, according to an example.

FIG. 6 is a flow diagram of a method for providing a PEG connector PCB, according to an example. Method 600 includes blocks 610 through 620. In alternate examples method 600 may include greater, or fewer, blocks. Method 600 begins at block 610 where a PCB is provided. For example, the PCB may be PEG connector PCB 130 of FIG. 4A. In some examples, providing the PCB further includes to provide the PCB with one or more internal plane layers, the number of internal plane layers configured to support an amount of current to be transported between the PEG connector and the set of connectors.

Also at block 610, the PEG connector is mounted to the PCB. For example, the PEG connector may be a 6-prong connector, and may be PEG connector 110 of FIG. 4A. The PEG connector is, as noted, configured to connect to an auxiliary power source for a device.

At optional block 615 a fan blower control unit may be provided on the PCB. In some examples this block may be skipped over, and method 600 may proceed from block 610 directly to block 60. In some examples, instead of, or in addition to, a fan blower unit, other components of the device may be provided on the PCB as well.

At block 620 the PCB is connected to a main PCB of a device. For example, the main PCB may be main circuit board 124 of FIG. 3A, and the device may be, for example, a hardware accelerator card of various types. In some examples, the PCB is mounted substantially perpendicularly to the main PCB of the device.

Method 600 may terminate at block 620.

While the foregoing is directed to embodiments of the present invention, other and further embodiments of the invention may be devised without departing from the basic scope thereof, and the scope thereof is determined by the claims that follow.

What is claimed is:

1. An auxiliary power connector, comprising:

a printed circuit board (PCB);

a peripheral connect interface express graphics (PEG) connector mounted to the PCB, the PEG connector configured to connect to an auxiliary power source; and a set of connectors provided on the PCB, the set of connectors configured to connect the PCB to a main PCB of a device, wherein the set of connectors comprise a row of metal pins held in place by a bar mounted on a planar surface of the PCB, wherein the row of metal pins extend parallel to the planar surface of the PCB and extend past an edge of the PCB.

2. The auxiliary power connector of claim 1, wherein the device is disposed on a peripheral connect interface express (PCI-e) card.

3. The auxiliary power connector of claim 1, wherein the auxiliary power connector is provided in a frame, and wherein the PCB is attached to a vertical wall of the frame.

4. The auxiliary power connector of claim 3, wherein the PCB is mounted substantially perpendicularly to the main PCB of the device.

5. The auxiliary power connector of claim 1, wherein the PEG connector is one of a 6-prong connector or an 8-prong connector.

6. The auxiliary power connector of claim 1, further comprising a second PEG connector mounted to the PCB.

7. The auxiliary power connector of claim 1, wherein the device is one of a graphics card or a hardware accelerator.

8. The auxiliary power connector of claim 1, wherein the PCB is further provided with one or more additional components that would otherwise be provided in the main PCB of the device.

9. The auxiliary power connector of claim 1, further comprising a first row of metal pins that extend parallel to a first planar surface of the PCB, and a second row of metal pins that extend parallel to a second planar surface of the PCB, wherein the first row of metal pins and the second row of metal pins extend past an edge of the PCB, wherein the first planar surface and second planar surface are located on opposing sides of the PCB and are co-planar.

10. The auxiliary power connector of claim 9, wherein the first row of metal pins and the second row of metal pins pass through the bar and are held in place by the bar.

11. The auxiliary power connector of claim 1, wherein the PCB comprises one or more internal plane layers connected to the set of connectors and configured to support an amount of current to be transported between the PEG connector and the set of connectors.

12. A method of providing an auxiliary power connector, comprising:

providing a printed circuit board (PCB);

mounting a peripheral connect interface express graphics (PEG) connector to the PCB, the PEG connector configured to connect to an auxiliary power source; and providing the PCB with a set of connectors, the set of connectors configured to connect the PCB to a main PCB of a device, wherein the set of connectors comprise a row of metal pins held in place by a bar mounted on a planar surface of the PCB, wherein the row of metal pins extend parallel to the planar surface of the PCB and extend past an edge of the PCB.

13. The method of claim 12, wherein the device is a peripheral connect interface express (PCI-e) card.

14. The method of claim 12, further comprising attaching the PCB to a frame of the device, and wherein the PCB is attached to a vertical wall of the frame, and is mounted substantially perpendicularly to the main PCB of the device.

15. The method of claim 12, wherein the PEG connector is one of a 6-prong connector or an 8-prong connector.

16. The method of claim 12, wherein the device is one of a graphics card or a hardware accelerator.

17. The method of claim 12, further comprising providing the PCB with one or more additional components that would otherwise be provided in the main PCB of the device.

18. The method of claim 12, further comprising a first row of metal pins that extend parallel to a first planar surface of the PCB, and a second row of metal pins that extend parallel to a second planar surface of the PCB, wherein the first row of metal pins and the second row of metal pins extend past an edge of the PCB, wherein the first planar surface and second planar surface are located on opposing sides of the PCB and are co-planar.

19. The method of claim 18, wherein the first row of metal pins and the second row of metal pins pass through the bar and are held in place by the bar.

20. The method of claim 12, wherein providing the PCB further comprises providing the PCB with one or more internal plane layers, electrically connected to the set of connectors and configured to support an amount of current to be transported between the PEG connector and the set of connectors.

* * * * *